US009342005B2

(12) United States Patent
Murasaki

(10) Patent No.: US 9,342,005 B2
(45) Date of Patent: May 17, 2016

(54) FIXING APPARATUS

(71) Applicant: CANON KABUSHIKI KAISHA, Tokyo (JP)

(72) Inventor: Satoshi Murasaki, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 14/869,690

(22) Filed: Sep. 29, 2015

(65) Prior Publication Data

US 2016/0091846 A1 Mar. 31, 2016

(30) Foreign Application Priority Data

Sep. 30, 2014 (JP) ..... 2014-201850

(51) Int. Cl.
*G03G 15/20* (2006.01)

(52) U.S. Cl.
CPC ..... *G03G 15/2053* (2013.01)

(58) Field of Classification Search
CPC ..... G03G 15/2053; G03G 15/2042; G03G 2215/20; G03G 2215/2035; G03G 15/04; G03G 15/0435; G03G 15/2007
See application file for complete search history.

(56) References Cited

U.S. PATENT DOCUMENTS

2007/0201914 A1* 8/2007 Tsuji ..... G03G 15/2053 399/328
2011/0182637 A1* 7/2011 Okada ..... G03G 15/2053 399/333

FOREIGN PATENT DOCUMENTS

| | | | |
|---|---|---|---|
| JP | H11-316509 | A | 11/1999 |
| JP | 2001-51529 | A | 2/2001 |
| JP | 2003-316182 | A | 11/2003 |
| JP | 2014-026267 | A | 2/2014 |

* cited by examiner

*Primary Examiner* — Roy Y Yi
(74) *Attorney, Agent, or Firm* — Canon USA Inc. IP Division

(57) ABSTRACT

A fixing apparatus includes a rotating member including a conductive layer; a helical coil arranged inside the rotating member, a helical axis of the coil extending in a generatrix direction of the rotating member; and a magnetic member provided inside the coil, the magnetic member including a first magnetic member and a second magnetic member arranged in a line extending in the generatrix direction. A toner image is fixed on a recording material by heat which the conductive layer generates by electromagnetic induction. In the generatrix direction, a protruded portion is provided on an end surface of the first magnetic member and a recessed portion is provided in an end surface of the second magnetic member. The protruded portion and the recessed portion are disposed so as to oppose each other and overlap each other in the generatrix direction.

14 Claims, 13 Drawing Sheets

FIXING APPARATUS

BACKGROUND OF THE INVENTION

1. Field of the Invention

The present disclosure relates to a fixing apparatus that is mounted in an image forming apparatus, such as an electrophotographic copying machine, a printer, or the like.

2. Description of the Related Art

A fixing apparatus mounted in an image forming apparatus, such as an electrophotographic copying machine, a printer, or the like typically adopts a heat fixing method in which a toner is melted by heat and is fixed on a recording material. In recent years, as one form of the heat fixing method, an electromagnetic induction heating fixing apparatus has been developed to practical use. The electromagnetic induction heating fixing apparatus has an advantage in that the warming-up time needed to raise the temperature to a temperature that enables fixing to be carried out is short.

Japanese Patent Laid-Open No. 2014-026267 discloses an electromagnetic induction heating fixing apparatus having a small thickness and little restriction in material quality of a conductive layer of a heat generating roller (a heat generating belt) that is a heat generating rotating member.

Typically, an electromagnetic induction heating fixing apparatus guides the lines of magnetic force that are generated by a coil into a desired shape with a magnetic member (a magnetic core). Ferromagnetic ceramics, such as ferrite, is typically used for the magnetic core. Since ceramics such as ferrite is formed using a mold, as the size becomes larger, it becomes harder to achieve precision and fabrication thereof becomes more difficult, and, consequently, the magnetic core becomes costly. Accordingly, a configuration that uses and arranges a plurality of small magnetic cores is typically employed.

Incidentally, in a fixing apparatus in which a helical-shaped coil is used and in which magnetic cores are disposed inside the coil, when there are gaps between the cores, the heat generation amount at each position corresponding to the gap decreases and the heat distribution of the heat generating roller becomes disadvantageously uneven. It has become known that the gaps between the magnetic cores have a large influence on the heat distribution particularly in devices with a shape such as the device disclosed in Japanese Patent Laid-Open No. 2014-026267 in which most of the lines of magnetic force that exit an end portion of the magnetic cores pass outside the heat generating roller and return to the other end of the magnetic cores. When the heat distribution becomes uneven, the quality of the image after fixing becomes degraded.

SUMMARY OF THE INVENTION

A first exemplary embodiment of the claimed disclosure is a fixing apparatus for fixing a toner image on a recording material, the apparatus including a rotating member including a conductive layer; a helical coil arranged inside the rotating member, a helical axis of the coil extending in a generatrix direction of the rotating member; and a magnetic member provided inside the coil, the magnetic member including a first magnetic member and a second magnetic member that are arranged in a line in a direction along the generatrix direction. In the fixing apparatus, a magnetic field is formed by a current flowing in the coil, the toner image is fixed on the recording material by heat which the conductive layer generate by electromagnetic induction in the magnetic field, a protruded portion is provided on an end surface of the first magnetic member in the generatrix direction, and a recessed portion is provided in an end surface of the second magnetic member in the generatrix direction, and the protruded portion and the recessed portion are disposed so as to oppose each other and overlap each other in the generatrix direction.

A second exemplary embodiment of the claimed disclosure is a fixing apparatus for fixing a toner image on a recording material, the apparatus including a rotating member including a conductive layer; a helical coil arranged inside the rotating member, a direction of a helical axis of the coil extending in a generatrix direction of the rotating member; and a magnetic member provided inside the coil, the magnetic member including a first magnetic member and a second magnetic member that are arranged in a line extending in the generatrix direction. In the fixing apparatus, the toner image is fixed on the recording material by heat radiated by the conductive layer caused by electromagnetic induction, and a biasing member that performs biasing such that the first magnetic member and the second magnetic member come in contact with each other is provided.

Further features of the present invention will become apparent from the following description of exemplary embodiments with reference to the attached drawings.

DESCRIPTION OF THE EMBODIMENTS

Figure 1:
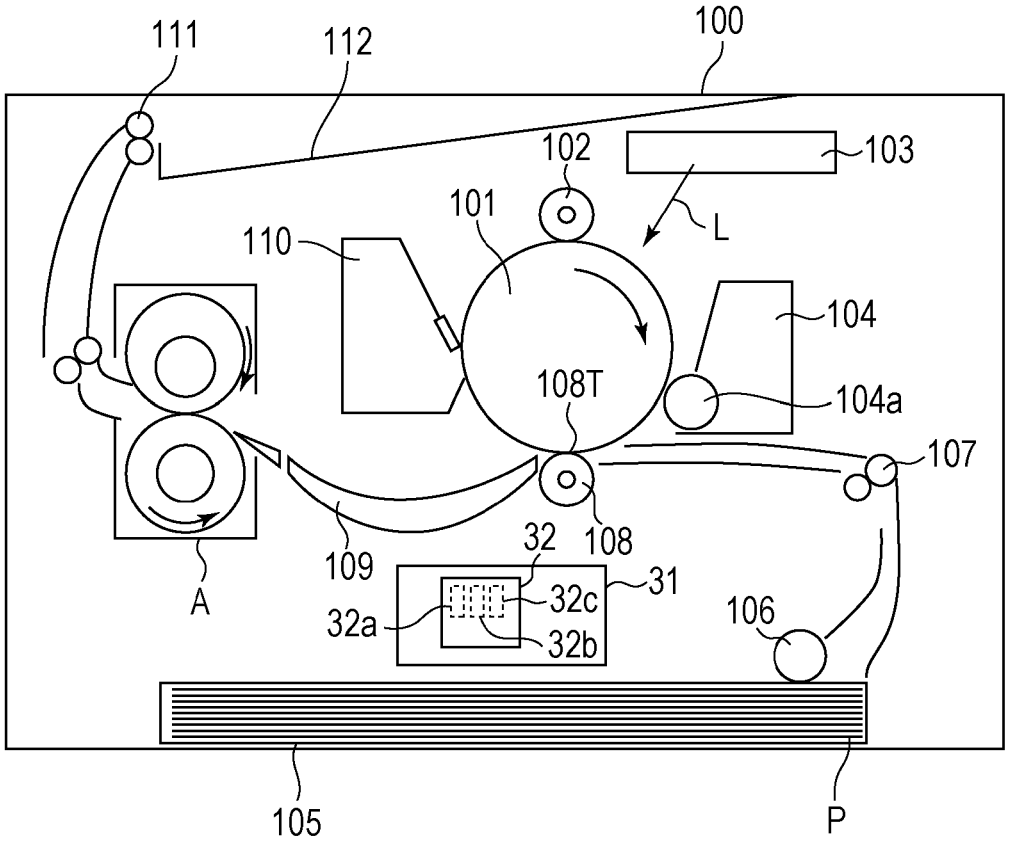
FIG. 1 is a block diagram of an image forming apparatus.

Hereinafter, referring to the drawings, modes to implement the present disclosure will be exemplified in detail with the exemplary embodiments. Note that the dimensions, the materials, and the shapes of the components, the relative configuration of the components, and the like that are described in the following exemplary embodiments are to be appropriately modified based on the device and on various conditions to which the present disclosure is applied. In other words, the scope of the disclosure is not intended to be limited by the exemplary embodiments below.

First Exemplary Embodiment

FIG. 1 is a schematic block diagram of an image forming apparatus 100. The image forming apparatus 100 is a laser beam printer employing an electrophotographic recording technology.

Reference numeral 31 is a controller that is a control unit of the image forming apparatus 100. The controller 31 includes a central processing unit (CPU) 32 including a ROM 32*a*, a RAM 32*b*, a timer 32*c*, and the like, and various input/output control circuits (not shown). Reference numeral 101 is an electrophotographic photoreceptor of a rotary drum type serving as an image carrying member. The photoreceptor 101 rotates at a predetermined speed in the direction of the arrow. A charging process is performed on the photoreceptor 101 in rotation by a charge roller 102 so that a surface of the photoreceptor 101 has a predetermined polarity and potential. Reference numeral 103 is a laser beam scanner that outputs a laser beam L on which an on/off modulation has been performed so as to correspond to image information input from an external device such as an image scanner or a host computer 42. A surface of the photoreceptor 101 on which the charging process has been performed is exposed to the laser beam L, and an electrostatic latent image corresponding to the image information is formed on the surface of the photoreceptor 101. Reference numeral 104 is a developing device that supplies a developing agent (toner) onto the surface of the photoreceptor 101 from a development roller 104*a* such that the electrostatic latent image on the surface of the photoreceptor 101 is developed into a toner image. Reference numeral 105 is a sheet feeding cassette in which a recording material P is accommodated. Reference numeral 107 is a registration roller that conveys the recording material P so that a leading end of the toner image formed on the photoreceptor 101 and a predetermined position of the recording material P coincide with each other. When a sheet feed start signal is input, the sheet feeding roller 106 is driven and the recording materials P in the sheet feeding cassette 105 are fed sheet by sheet. After the conveying timing has been adjusted with the registration roller 107, the recording material P that has been fed is guided to a transfer portion 108T where the photoreceptor 101 and a transfer roller 108 abuts against each other. While pinching and conveying the recording material P at the transfer portion 108T, a transfer bias is applied to the transfer roller 108 from a power supply (not shown). By applying a transfer bias that is opposite in polarity to the charge polarity of the toner to the transfer roller 108, the toner image on the photoreceptor 101 is transferred to the recording material P. Subsequently, the recording material P on which the toner image has been transferred is separated from the surface of the photoreceptor 101, passes through the conveyance guide 109, and is introduced into a fixing unit A. The toner image (an unfixed image) on the recording material P is heated in the fixing unit A and is fixed on the recording material P. The recording material P that has passed through the fixing unit A is discharged on an output tray 112 through a sheet output port 111. Meanwhile, the surface of the photoreceptor 101 after the recording material P has been separated therefrom is cleaned at a cleaning portion 110. Note that the printer of the present exemplary embodiment is a center-reference printer that is a printer in which the recording material P is conveyed while the center of the recording material P in the width direction is matched with a conveyance reference CR for the recording material P described later.

Figure 2:
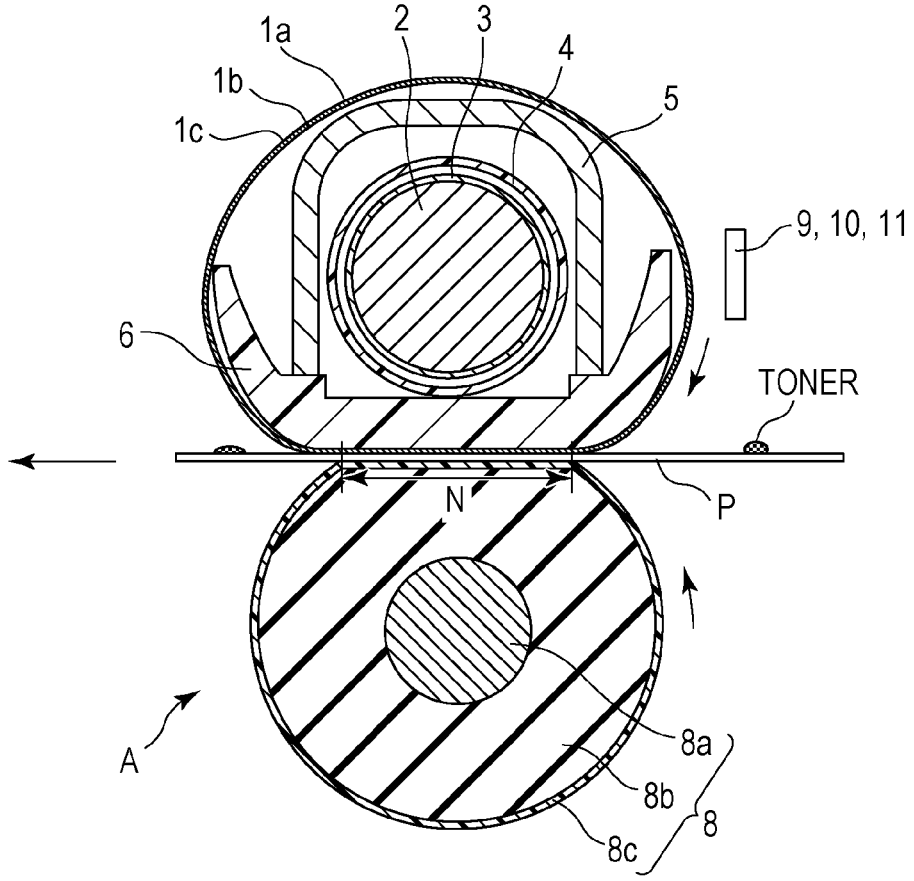
FIG. 2 is a cross-sectional view of a fixing apparatus.
Figure 3:
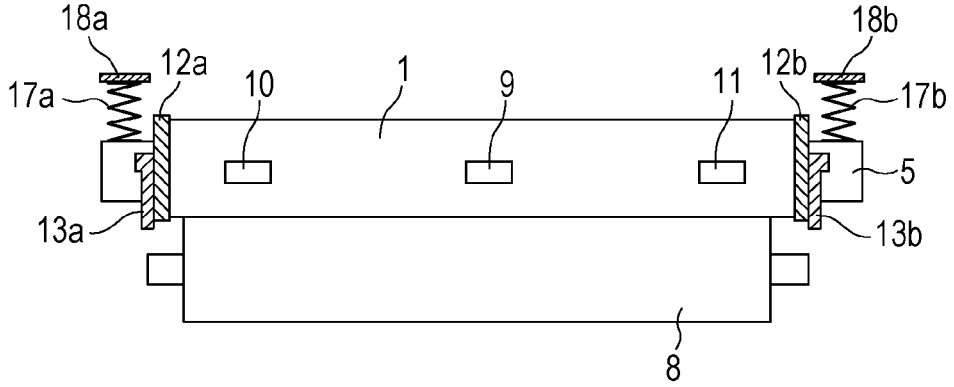
FIG. 3 is a front view of the fixing apparatus.
Figure 4:
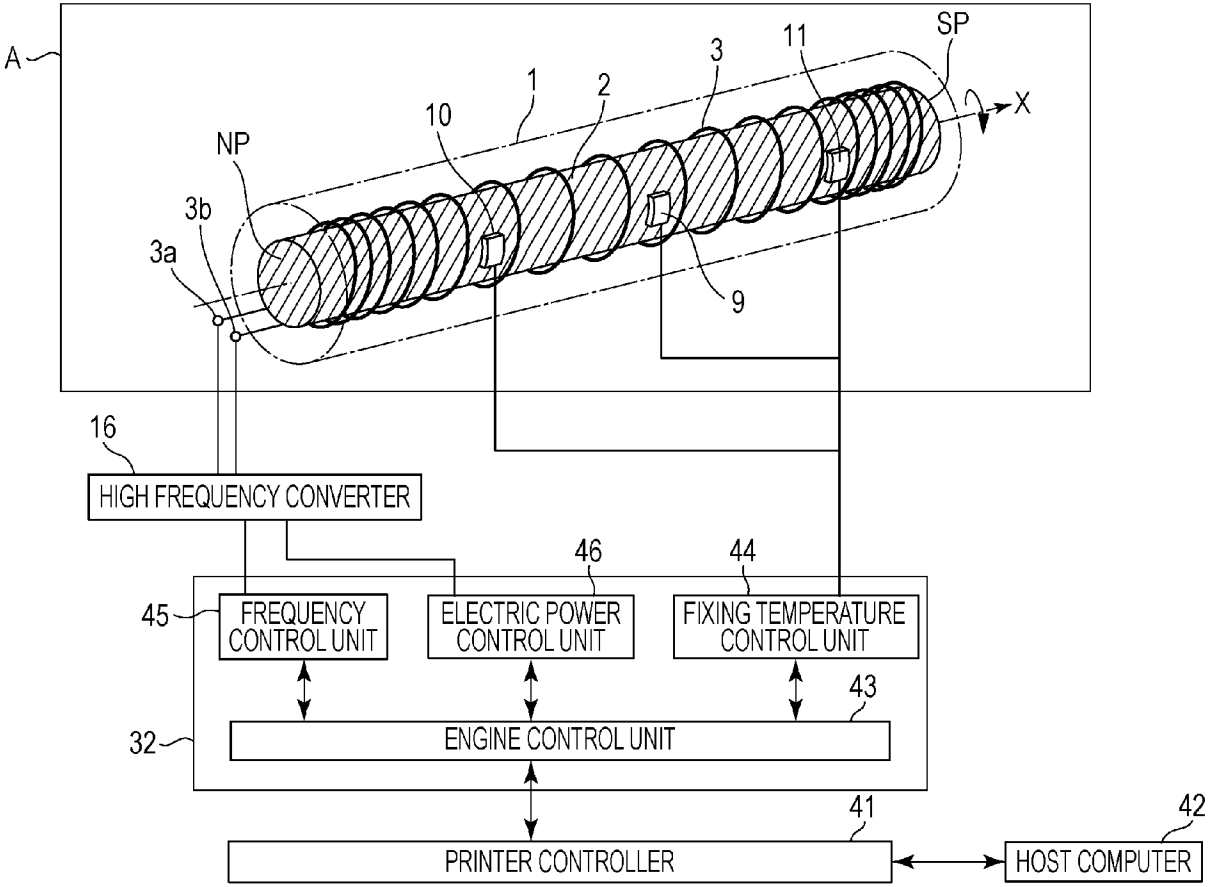
FIG. 4 is a block diagram of a control unit of a heating unit.
Figure 5A:
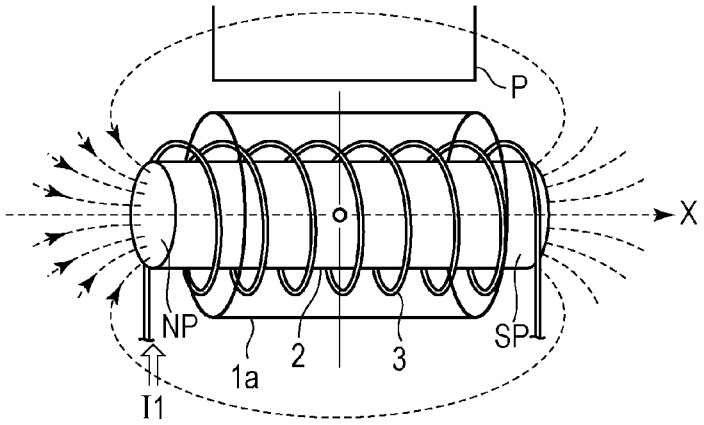
FIGS. 5A and 5B are diagrams illustrating a magnetic field generated by a coil and an electric current flowing in a conductive layer.
Figure 5B:
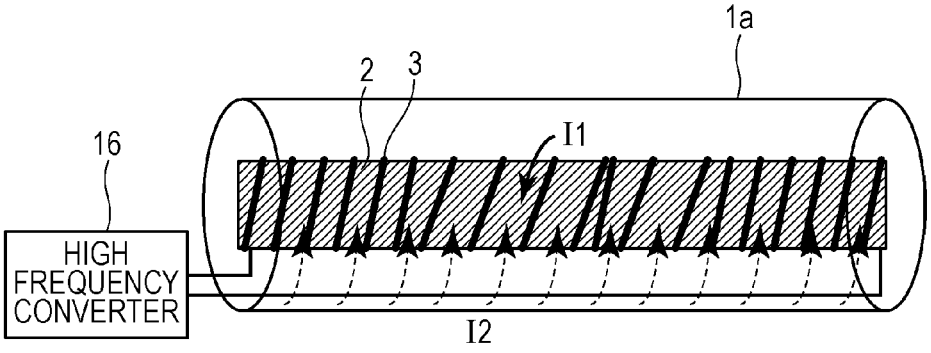

The fixing unit A is an electromagnetic induction heating fixing apparatus. Specifically, the fixing unit A is a fixing apparatus that heats a conductive layer of a rotating member by electromagnetic induction caused by a magnetic flux generated by a coil and that fixes an image formed on the recording material P on the recording material P with the heat of the rotating member. In other words, the image is fixed on the recording material P by heat that is radiated by the conductive layer caused by electromagnetic induction. FIG. 2 is a cross-sectional view of the fixing unit A, FIG. 3 is a front view of the fixing unit A, and FIG. 4 is a perspective view of a coil unit provided in the fixing unit A. FIGS. 5A and 5B illustrate a state of a magnetic field generated in the coil and an electric current flowing in the rotating member. The fixing unit A includes a heating unit including a fixing sleeve 1 and a coil unit described later, and a pressing member 8. A fixing nip portion N that pinches and conveys the recording material P carrying an unfixed toner image is formed between the heating unit and the pressing member 8. Note that as described later, a magnetic core 2 of the present exemplary embodiment is constituted by a plurality of small magnetic cores arranged in a single row in a generatrix direction of the rotating member; however, for simplicity of description, the magnetic core 2 is a single core in FIGS. 1 to 5A and 5B.

A pressing roller 8 serving as the pressing member includes a metal core 8*a*, an elastic layer 8*b* formed of silicone rubber and the like, and a release layer 8*c* formed of fluorocarbon resin and the like. The two end portions of the metal core 8*a* are rotatably held between device chassis (not shown) of the fixing unit through bearings. Furthermore, by providing pressurizing springs (compression springs in the present exemplary embodiment) 17*a* and 17*b* between two end portions of a pressurizing stay (a metal reinforcement member) 5 illustrated in FIG. 3 and spring receiving members 18*a* and 18*b* on the device chassis side, a depressing force acts on the pressurizing stay 5. In the fixing unit A of the present exemplary embodiment, a pressing force amounting to about 100 N to 250 N (about 10 kgf to about 25 kgf) in total is applied. With the above, an underside of the sleeve guide member 6 constituted by a heat-resistant resin (PPS or the like) and the pressing roller 8 come in pressure contact with each other while pinching the fixing sleeve 1 in between such that a fixing nip portion N is formed. The pressing roller 8 is driven in the direction of the arrow with a driving device (not shown), and the fixing sleeve 1 is rotated by following the rotation of the pressing roller 8. Reference numerals 12*a* and 12*b* are flange members that are rotated by following the rotation of the fixing sleeve 1. The flange members 12*a* and 12*b* are rotatably disposed at the end portions of the sleeve guide member 6 in the longitudinal direction thereof. When the rotating fixing sleeve 1 laterally shifts in the generatrix direction, the rotating fixing sleeve 1 bumps against the flange member 12*a* or 12*b*, and the flange member 12*a* or 12*b* that has been pushed by the fixing sleeve 1 bumps against a restriction member 13*a* (13*b*). With the above, the lateral shifting of the fixing sleeve 1 is regulated by the restriction member 13*a* (13*b*). The flange members 12*a* and 12*b* are formed of a material with fine heat resistance properties such as a liquid crystal polymer (LCP).

The fixing sleeve 1 serving as a rotatable cylindrical rotating member preferably is 10 to 50 mm in diameter and includes a flexible member that includes a heat generating layer (a conductive layer) 1*a* serving as a base layer, an elastic layer 1*b* laminated on the outer surface of the heat generating layer 1*a*, and a release layer 1*c* that is the surface of the sleeve 1. The heat generating layer 1*a* is a metal film (the material of the sleeve of the present exemplary embodiment is stainless steel) and the film thickness is preferably 10 to 50 μm. The elastic layer 1*b* is formed of silicone rubber and, preferably, the hardness is about 20 degrees (JIS-A, loading of 1 kg) and the thickness is 0.1 mm to 0.3 mm. The release layer 1*c* is a fluorocarbon resin tube and preferably has a thickness of 10 to 50 μm. Induced current is generated in the heat generating layer 1*a* with the effect of the alternating flux described later. The heat generating layer 1*a* generates heat with the induced current and the heat is transmitted to the elastic layer 1*b* and the release layer 1*c* such that the entire fixing sleeve 1 in the circumferential direction is heated. Note that temperature detection elements 9, 10, and 11 that detect the temperatures of the fixing sleeve 1 will be described later.

A mechanism generating the induced current in the heat generating layer 1*a* will be described next in detail. FIG. 4 is a perspective view of the coil unit provided in the heating unit. The coil unit is disposed inside the rotating member (fixing sleeve) 1 and includes a helical-shaped coil that forms an alternating magnetic field that heats the conductive layer 1*a* by electromagnetic induction. A helical axis of the coil is substantially parallel to the generatrix direction of the rotating member 1. Note that it is only sufficient that the helical axis of the coil extends in the generatrix direction of the rotating member 1. A magnetic member (referred to also as core or magnetic core) 2 for guiding lines of magnetic force (magnetic flux) of the alternating magnetic field is provided inside the coil. As described later, the magnetic core 2 of the present exemplary embodiment is constituted by the plurality of small magnetic cores arranged in a single row in the generatrix direction of the rotating member. The magnetic core 2 is disposed so as to penetrate the hollow portion of the fixing sleeve 1 with a securing device (not shown). The magnetic poles of the core 2 are indicated by NP and SP. The core 2 has two ends and the magnetic flux generated by the coil forms an open magnetic circuit. The material of the core can be a material with a small hysteresis loss and with a high relative magnetic permeability. For example, the material can be a ferromagnetic body that is composed of, for example, an oxide with high permeability or an alloy such as a baked ferrite, a ferrite resin, an amorphous alloy, and a permalloy. In the present exemplary embodiment, a baked ferrite with a relative magnetic permeability of 1800 is used. The core of the present exemplary embodiment has a cylindrical shape and preferably has a diameter of 5 to 30 mm. In a case of a fixing apparatus that is mounted in a printer for A4-size sheets, the length of the core 2 is preferably about 280 mm. Note that the core 2 on which a coil 3 is wounded is covered with a resin core holder 4 and is held by the core holder 4.

The energizing coil 3 is formed by helically winding, in the hollow portion of the fixing sleeve 1, a single lead wire on the magnetic core 2. In so doing, the lead wire is wound so that the interval at the end portions of the core in an axial direction of the core is densely wound with respect to the interval at the middle portion of the core in the axial direction. The energizing coil 3 is wounded 18 times onto the magnetic core 2 having a longitudinal dimension of 280 mm. The winding interval at the end portions is 10 mm, is 20 mm at the middle portion, and is 15 mm in between. As described above, the coil is wounded in a direction intersecting an axial line X of the core.

When a high-frequency electric current I1 is distributed in the energizing coil 3 with a high frequency converter 16 through power feed contact portions 3*a* and 3*b*, lines of magnetic force (magnetic flux) are generated. As illustrated in FIG. 5A, the apparatus of the present exemplary embodiment is designed so that most (70% or more, preferably 90% or more, more preferably 94% or more) of the magnetic flux that exit an end portion of the core 2 returns to the other end of the core 2 after passing the portion outside the heat generating layer 1*a* of the fixing sleeve 1. Accordingly, an induced current (a circulating current) 12 that flows in the heat generating layer 1*a* of the fixing sleeve 1 in a circumferential direction is generated so as to generate a magnetic flux that cancels out the magnetic flux passing the outside of the fixing sleeve 1 (FIG. 5B). With the above, the entire heat generating layer 1*a* in the circumferential direction generates heat. As described above, with a configuration in which the induced current flows in the circumferential direction of the fixing sleeve 1, the entire area of the fixing sleeve 1 in the circumferential direction generates heat and an advantage that the time it takes to warm up the fixing apparatus to a temperature that enables fixing to be carried out can be shortened can be obtained. Furthermore, since the apparatus of the present exemplary embodiment is configured so that the core 2 has two ends and an open magnetic circuit is formed, most of the magnetic flux passes outside the heat generating layer 1*a*. Accordingly, the apparatus of the present exemplary embodiment has an advantage in that the apparatus can be made smaller than an apparatus that forms the core in a loop shape and that forms a closed magnetic circuit. Note that in the present exemplary embodiment, the electric current I1 is a high frequency alternating current of 100 kHz.

As illustrated in FIG. 2, the temperature detection elements 9, 10, and 11 of the fixing unit A are disposed upstream of the fixing nip portion N in the rotation direction of the fixing sleeve 1 and detect the surface temperature of the fixing sleeve 1. Furthermore, as illustrated in FIG. 3, the temperature detection elements 9, 10, and 11 detect the temperatures of the center and the two end portions of the fixing sleeve 1 in the longitudinal direction of the fixing unit A. Thermistors or the like are used as the temperature detection elements 9, 10, and 11. Supply of power to the coil is controlled so that the detection temperature of the temperature detection element 9 at the middle portion is maintained at a control target temperature that is suitable for fixing. Furthermore, the temperature detection elements 10 and 11 that are disposed in the vicinities of the end portions of the fixing sleeve 1 are capable of detecting the temperature rise of the non-sheet passing area of the fixing sleeve 1 when small-sized recording materials P are continuously printed. Note that the temperature detection elements 10 and 11 may be disposed at the end portions of the pressing roller 8 in the axial direction to detect the rise in temperature of the non-sheet passing area of the pressing roller 8 when small-sized recording materials P are continuously printed.

FIG. 4 is a block diagram illustrating the relationship between a CPU 32, a printer controller 41, and the host computer 42 that are control devices that control the printer. The printer controller 41 performs communication with the host computer 42 described later, receives image data, and develops the received image data into data that the image forming apparatus 100 can print. Furthermore, the printer controller 41 performs transmission of signals and serial communication with an engine control unit 43. The engine control unit 43 performs transmission of signals with the printer controller 41 and, further, controls units 44 to 46 of the image forming apparatus 100 through serial communication. A fixing temperature control unit 44 performs, on the basis of the temperature detected by the temperature detection elements 9, 10, and 11, temperature control of the fixing unit A and performs abnormality detection and the like of the fixing unit A. A frequency control unit 45 serving as a frequency control device controls the drive frequency of the high frequency converter 16, and an electric power control unit 46 turns the drive of the high frequency converter 16 ON and OFF to control the electric power to the high frequency converter 16. Specifically, the electric power control unit 46 turns the drive of the high frequency converter 16 ON and OFF so that the detection temperature of the temperature detection element 9 is maintained at the control target temperature. The host computer 42 transfers image data to the printer controller 41 and transfers various printing conditions, such as the size of the recording material P, to the printer controller 41 on the basis of a request from a user.

Figure 6A:
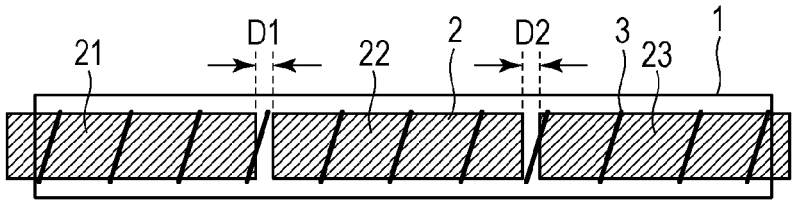
FIGS. 6A to 6C are diagrams illustrating an effect exerted by dividing a core.
Figure 6B:
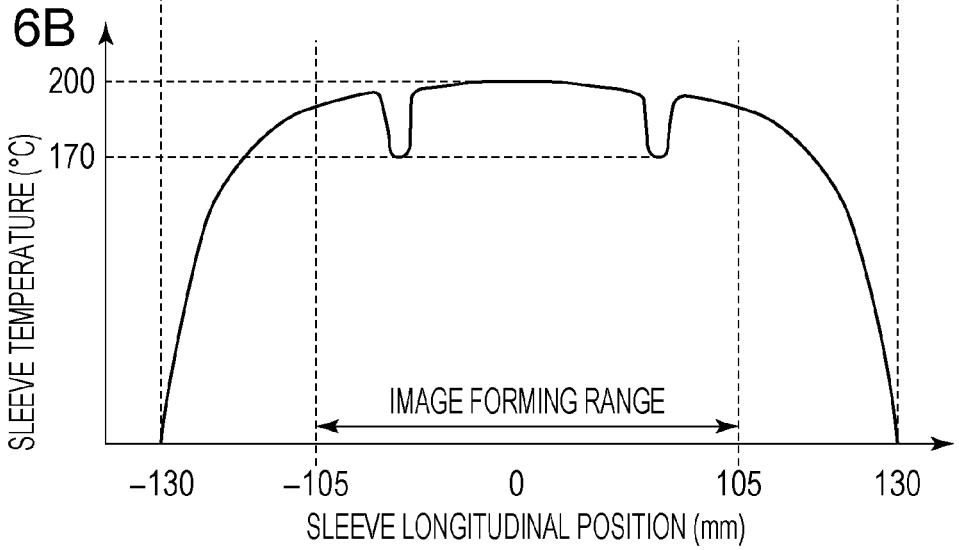

In the above-described configuration, a configuration in which the magnetic core 2 is divided into three pieces so that the manufacturing cost of the magnetic core 2 is reduced and so that damage such as a crack or the like does not occur in the magnetic core 2 when an impact is applied by, for example, dropping the fixing unit A will be described. That is, three cores 21 to 23 constitute the core 2. FIG. 6A is a front view of the heating unit in which gaps D1 and D2 are generated in the divided areas of the magnetic core 2, and FIG. 6B is a diagram illustrating a heat distribution of the fixing sleeve 1 in the longitudinal direction during the above.

Figure 6C:
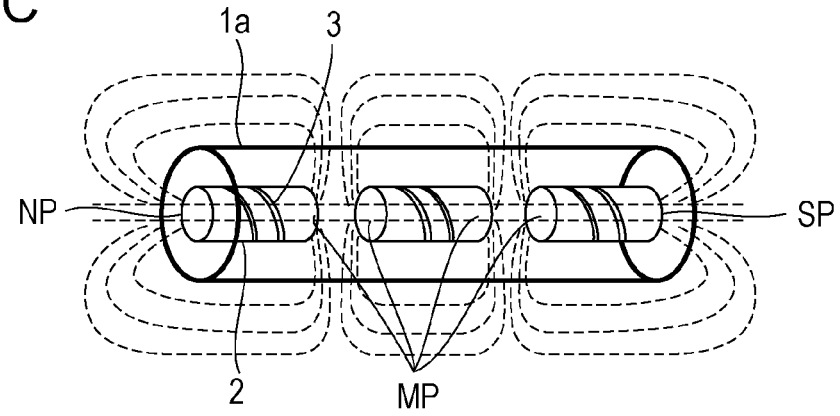

Since the areas of the gaps D1 and D2 are layers of air, magnetic permeability is low. Accordingly, as illustrated in FIG. 6C, magnetic poles are formed in portions MP of the magnetic core 2 other than the two end portions NP and SP, and the lines of magnetic force penetrating the core 2 in the longitudinal direction decrease in the divided areas. Because of the above, electromotive force guided to the areas of the fixing sleeve 1 corresponding to the gaps D1 and D2 becomes small as well. Then, as in FIG. 6B, a phenomenon in which the temperatures of the fixing sleeve 1 corresponding to the gaps D1 and D2 become low occurs. In FIG. 6B, the fixing sleeve 1 is controlled so that the temperature is kept at 200° C.; however, portions in which decrease in temperature has occurred is, disadvantageously, 170° C. When the shape of the divided area of each core is a flat surface and when there is a gap of about 100 μm, a decrease in temperature of about 30° C. occurs in the portion of the fixing sleeve 1 corresponding to the gap portion. Note that the printer of the present exemplary embodiment corresponds to A4-size sheets and the image forming range illustrated in FIG. 6B is the range of the maximum image size that can be formed on the recording material P.

Figure 7A:
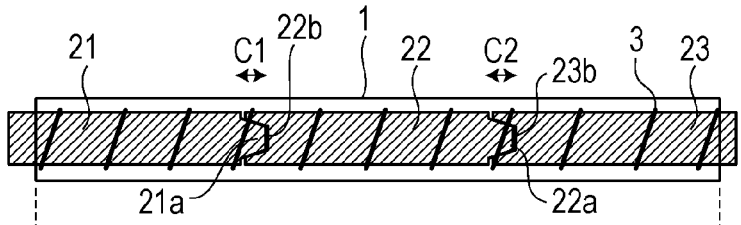
FIGS. 7A to 7C are explanatory drawings of a core of a first exemplary embodiment and a heat distribution.
Figure 7B:
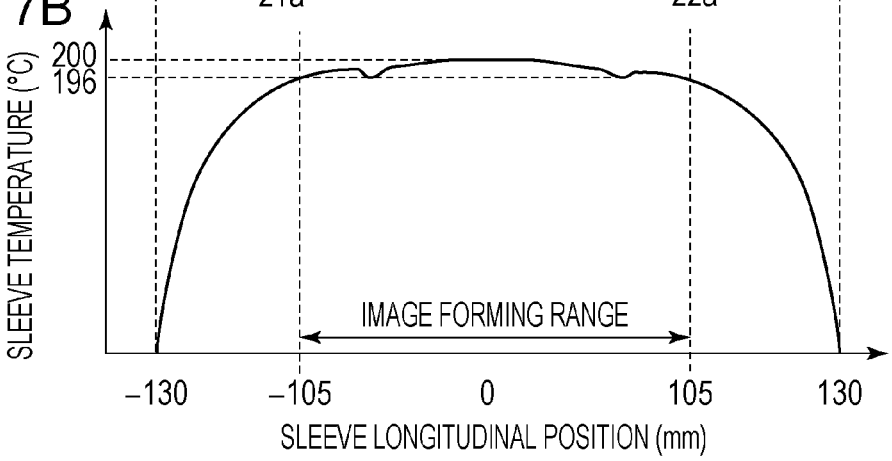
Figure 7C:
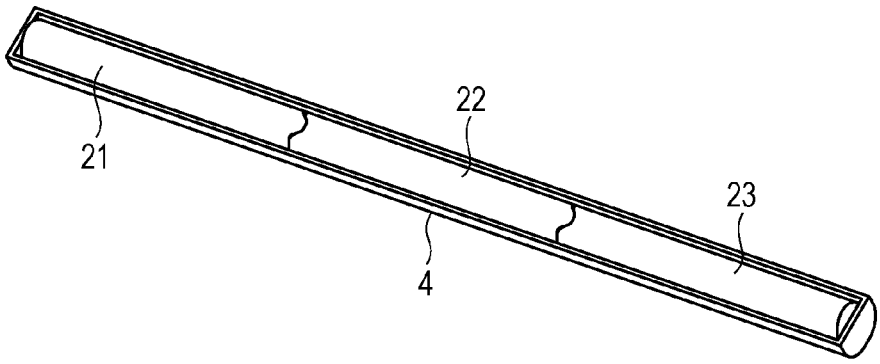

FIGS. 7A to 7C illustrate a cross-sectional view of the core of the first exemplary embodiment and a heat distribution of the fixing sleeve 1. The divided areas of the core are indicated by C1 and C2. In the present exemplary embodiment, the magnetic flux is guided by combining three cores, namely, a core (a first magnetic member) 21, a core (a second magnetic member) 22, and a core (a third magnetic member) 23. Note that the outside diameters of the three cores are the same (in FIG. 8A, a core 21 with an outside diameter of 21ϕ and a core 22 with an outside diameter of 22ϕ are illustrated).

As illustrated in FIG. 7A, the core 21 is provided with a protruded portion 21*a*. The protruded portion 21*a* is a portion that is smaller than the outside diameter 21 ϕ of the core 21 and that protrudes in the helical axis direction of the coil. A recessed portion 22*b* that is recessed in the helical axis direction of the coil is provided in a portion of the core 22 that opposes the protruded portion 21*a*. Furthermore, by fitting the protruded portion 21*a* and the recessed portion 22*b* to each other, the core 21 and the core 22 overlap each other in the helical axis direction of the coil. The core 23 and the core 22 overlap each other in the helical axis direction of the coil. A protruded portion 22*a* is provided in the end portion of the core 22 that is on the opposite side with respect to the end portion in which the recessed portion 22*b* is provided, and a recessed portion 23*b* that opposes the protruded portion 22*a* of the core 22 is provided in the core 23. As illustrated in FIG. 7C, the cores 21, 22, and 23 on which the coil 3 has been wound are accommodated in the core holder 4. Note that the core holder 4 is an assembled body of two gutter-shaped divided holders, and FIG. 7C illustrates only one of the divided holders.

As described above, by having the protruded portions and the recessed portions fit each other such that the cores overlap each other in the helical axis direction of the coil, leaking of the magnetic flux passing through the inside of the cores can be reduced at the divided areas C1 and C2. In other words, the protruded portions and the recessed portions are provided so as to oppose and overlap each other in the generatrix direction of the rotating member. FIG. 7B illustrates a temperature distribution of the fixing sleeve 1 in a case in which the core of the present exemplary embodiment is employed. As illustrated in the drawing, the temperature of the fixing sleeve 1 at the positions corresponding to the divided area can be 196° C. Note that "the protruded portions and the recessed portions fitted to each other" herein includes being fitted in a looser manner than when "clearance fitted" or "interference fitted".

A configuration that is capable of suppressing a load from being applied to the core in a case in which an impact is applied to the fixing unit A by, for example, dropping the fixing unit A will be described next. There is a space between the core holder 4 and the cores 21 to 23 accommodated therein. Accordingly, when an impact is applied, an external force that deforms the cores is disadvantageously applied to the cores 21 to 23.

Figure 8A:
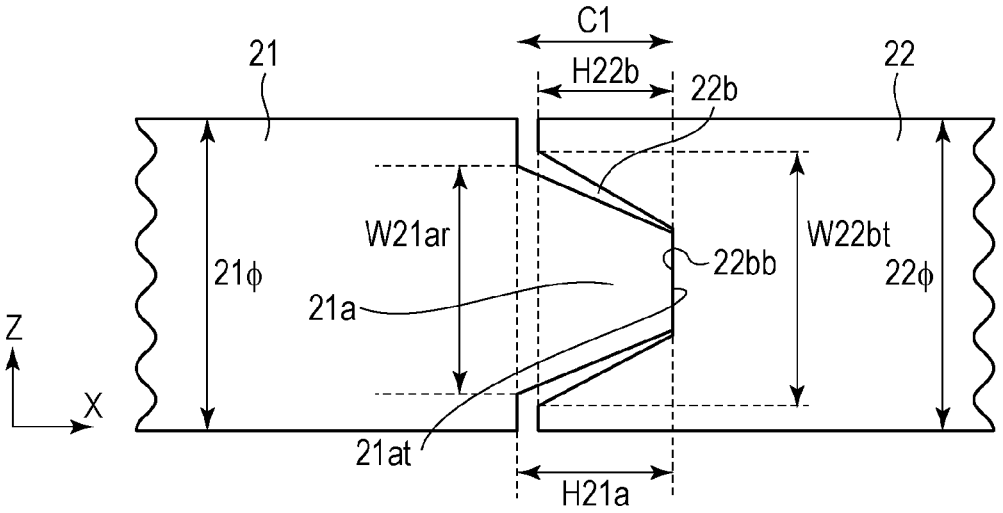
FIGS. 8A and 8B are diagrams illustrating a shape of the core of the first exemplary embodiment.
Figure 8B:
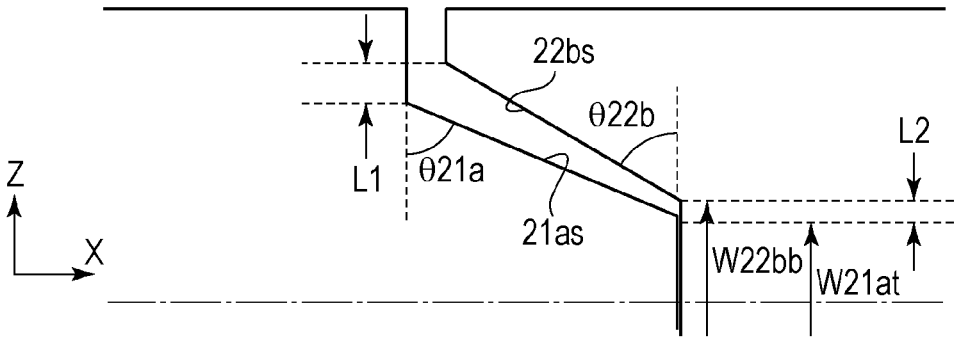
Figure 9A:
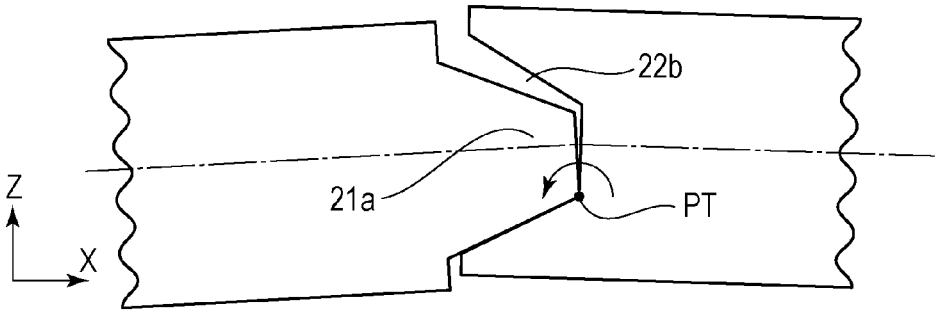
FIGS. 9A and 9B are diagrams illustrating the movement of the core when an external force is applied to the core.
Figure 9B:
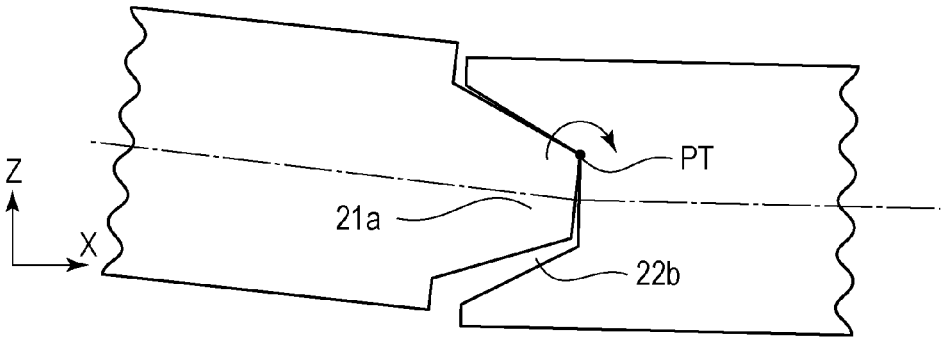
Figure 10:
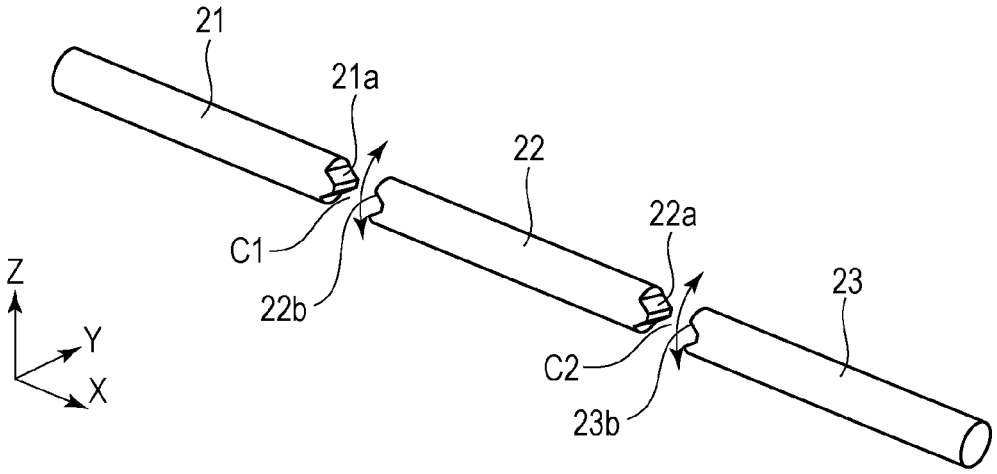
FIG. 10 is a perspective view of the core of the first exemplary embodiment.

FIGS. 8A and 8B are enlarged views of the divided area, FIGS. 9A and 9B are diagrams illustrating a state in which an external force is applied to the cores, and FIG. 10 is a perspective view of the cores. Note that while FIGS. 8A to 9B each illustrate an enlarged view of the divided area C1, since the shape of the divided area C2 is similar to that of C1, the description of the divided area C2 is omitted. A shape of the cores with an improved impact resistance will be described below.

As illustrated in FIGS. 8A and 8B, a height H21*a* of the protruded portion 21*a* is greater than a depth H22*b* of the recessed portion 22*b*. The protruded portion 21*a* has a shape that becomes narrower as the protruded portion 21*a* extends towards its tip 21*at*, and the recessed portion 22*b* has a shape in which the width becomes narrower as the recessed portion 22*b* extends towards its bottom 22*bb*. A width W21*ar* of the base of the protruded portion 21*a* is smaller than a width W22*bt* of the leading end of the recessed portion 22*b*. A width W21*at* of the tip of the protruded portion 21*a* is smaller than a width W22*bb* of the bottom of the recessed portion 22*b*. Furthermore, an angle θ21*a* of an inclined surface 21*as* of the protruded portion 21*a* is larger than an angle θ22*b* of an inclined surface 22*bs* of the recessed portion 22*b*.

The difference between the width W22*bt* of the leading end of the recessed portion 22*b* and the width W21*ar* of the base of the protruded portion 21*a* is assumed to be L1 (in FIG. 8B, only the L1 on one side with respect to the central axis of the core is illustrated and the actual difference is twice the L1). Furthermore, the difference between the width W22*bb* of the bottom of the recessed portion 22*b* and the width W21*at* of the tip of the protruded portion 21*a* is assumed to be L2 (in the case of L2 as well, the actual difference is twice the L2 in the drawing). L1 and L2 satisfy relationship L2 L1.

With the above, as illustrated in FIGS. 9A and 9B, the core 21 is capable of swinging in the up-down direction (a Z-direction) with the tip of the protruded portion 21*a* as a pivoting center PT; accordingly, even if an impact is applied to the core by, for example, dropping the fixing apparatus, the impact can be relieved and the core can be prevented from being damaged.

Figure 11:
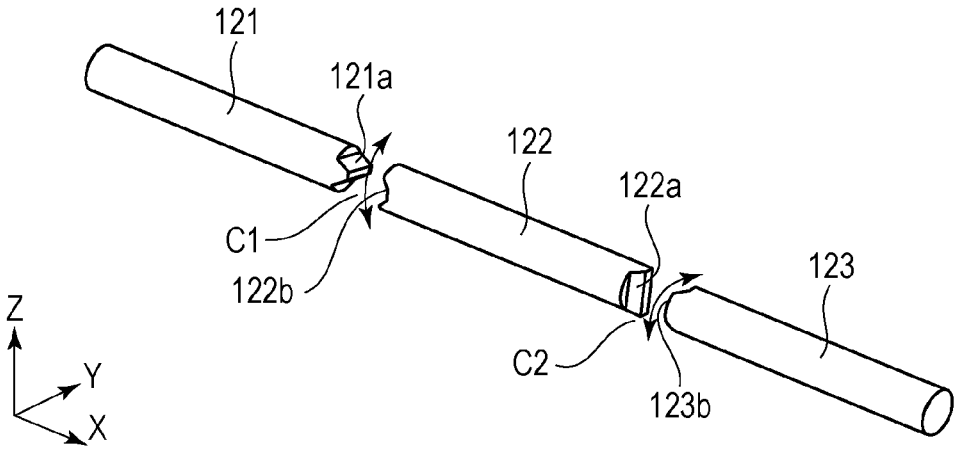
FIG. 11 is a perspective view of a core of a first modification.

Furthermore, as illustrated in FIG. 10, in the core of the present exemplary embodiment, a phase of the protruded portion 21*a* of the core 21 and a phase of the protruded portion 22*a* of the core 22 are substantially the same in a circumferential direction of the core 22, and the direction in which swinging can be performed in the divided areas C1 and C2 are both the Z-direction. However, as in a first modification illustrated in FIG. 11, the phase of the protruded portion 21*a* of the core 21 and the phase of the protruded portion 22*a* of the core 22 in the circumferential direction of the core 22 may be different. In the example in FIG. 11, the phases are shifted by 90 degrees. In the example in FIG. 11, swinging can be performed in the Z-direction in the divided area C1 and swinging can be performed in the Y-direction in the divided area C2. With the above, impact applied to the core can be relieved further.

Figure 12:
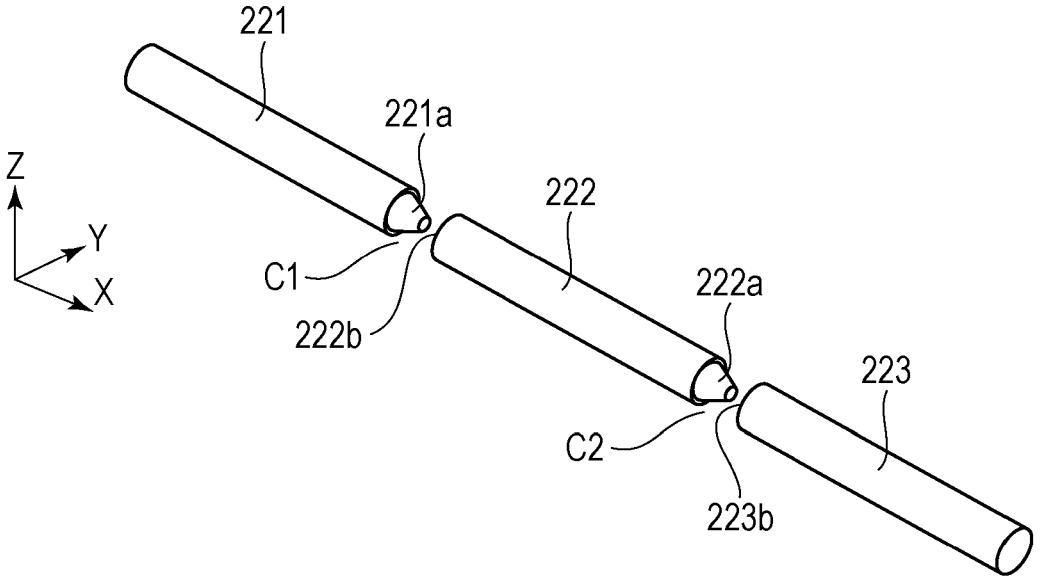
FIG. 12 is a perspective view of a core of a second modification.

FIG. 12 illustrates a perspective view of a core of a second modification. The cross section is the same as that in FIG. 8A. In the present modification as well, the core is divided into three pieces, namely, the cores 221, 222, and 223. Furthermore, the protruded portions 221*a* and 222*a* each have a conical shape and the recessed portions 222*b* and 223*b* each have a conical shape.

Figure 13A:
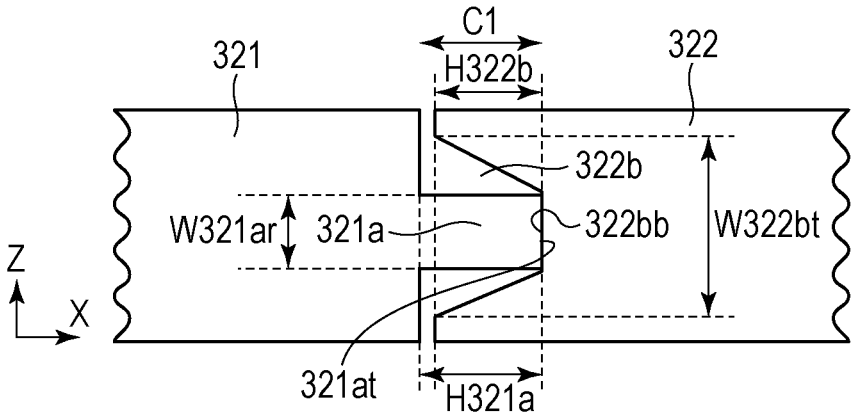
FIGS. 13A to 13C include cross-sectional views and a perspective view of a core of a third modification.
Figure 13B:
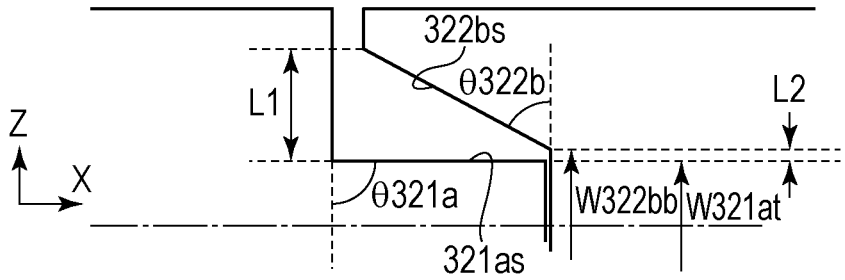
Figure 13C:
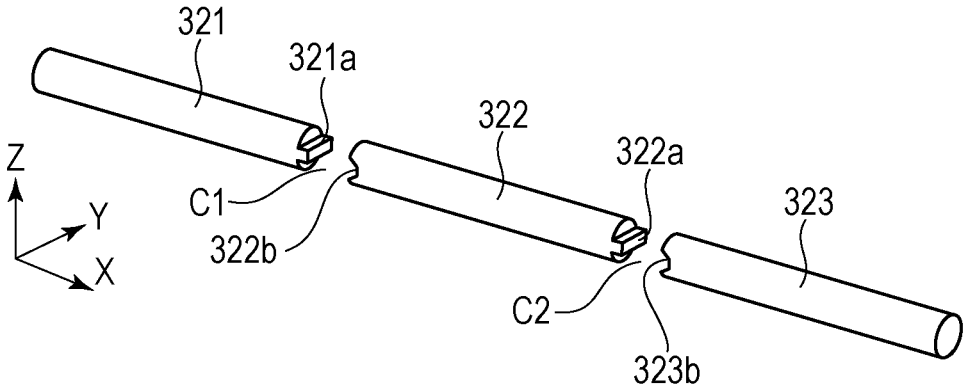

FIGS. 13A to 13C illustrate cross-sectional views and a perspective view of a core of a third modification. As illustrated in FIGS. 13A and 13B, a height H321*a* of a protruded portion 321*a* is greater than the depth H322*b* of a recessed portion 322*b*. The protruded portion 321*a* has a thickness that is the same from the base to a tip 321*at*, and the recessed portion 322*b* has a shape in which the width becomes narrower as the recessed portion 322*b* extends towards a bottom 322*bb*. A width W321*ar* of the base of the protruded portion 321*a* is smaller than a width W322*bt* of the leading end of the recessed portion 322*b*. A width W321*at* of the tip of the protruded portion 321*a* is smaller than a width W322*bb* of the bottom of the recessed portion 322*b*. Furthermore, an angle θ321*a* (90° in the present example) of an inclined surface 321*as* of the protruded portion 321*a* is larger than an angle θ322*b* of an inclined surface 322*bs* of the recessed portion 322*b*.

A difference L1 between the width W322*bt* of the leading end of the recessed portion 322*b* and the width W321*ar* of the base of the protruded portion 321*a*, and a difference L2 between the width W322*bb* of the bottom of the recessed portion 322*b* and the width W321*at* of the tip of the protruded portion 321*a* satisfy relationship L2 L1.

Figure 14A:
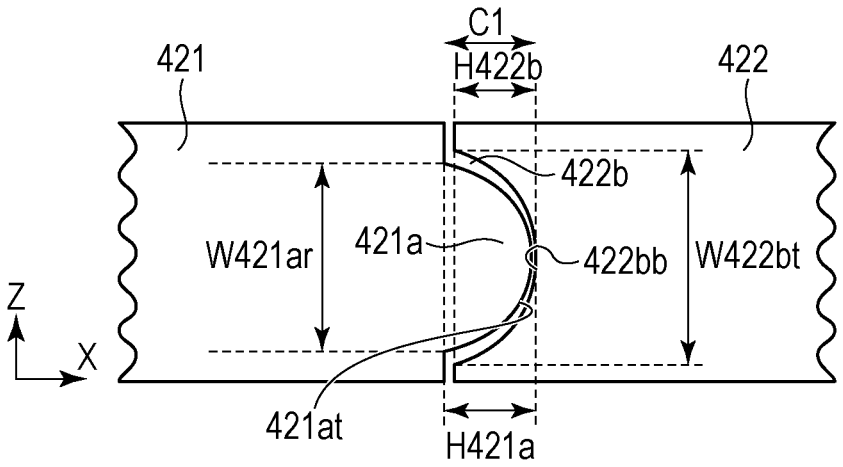
FIGS. 14A to 14C include cross-sectional views and a perspective view of a core of a fourth modification.
Figure 14B:
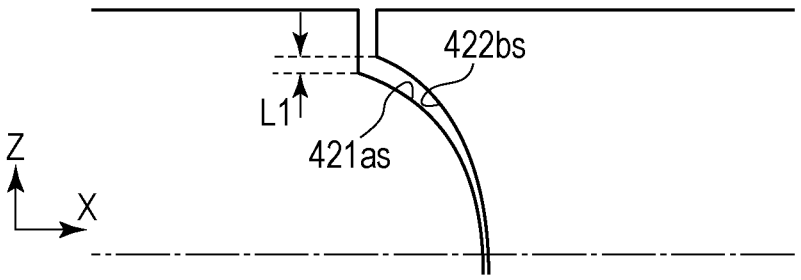
Figure 14C:
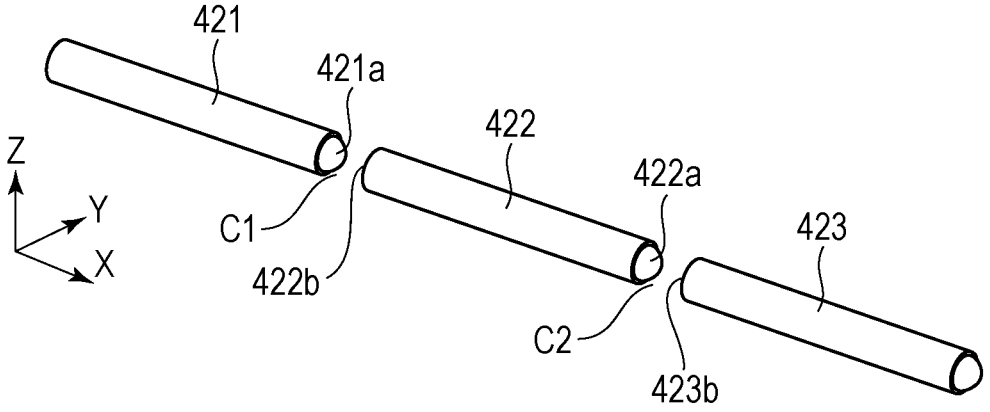

FIGS. 14A to 14C illustrate cross-sectional views and a perspective view of a core of a fourth modification. As illustrated in FIGS. 14A and 14B, a height H421*a* of a protruded portion 421*a* is greater than the depth H422*b* of a recessed portion 422*b*. The protruded portion 421*a* has a spherical surface having a tip 421*at* as its apex, and the recessed portion 422*b* also has a spherical surface having a bottom 422*bb* as its bottom. A width W421*ar* of the base of the protruded portion 421*a* is smaller than a width W422*bt* of the leading end of the recessed portion 422*b*. Furthermore, a curvature of an arc surface 421*as* of the protruded portion 421*a* is larger than a curvature of an of an arc surface 422*bs* of the recessed portion 422*b*. A difference L1 is provided between the width W422*bt* of the leading end of the recessed portion 422*b* and the width W421*ar* of the base of the protruded portion 421*a*.

The first to fourth modifications described above are capable of further relieving the impact applied to the core.

Second Exemplary Embodiment

Figure 15A:
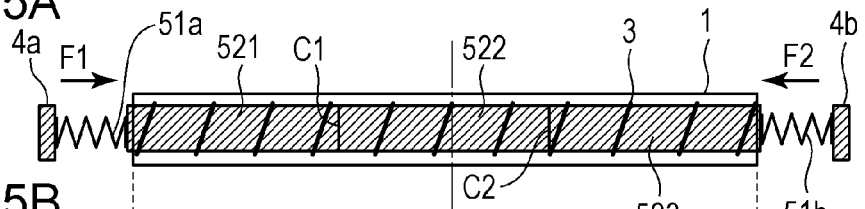
FIGS. 15A to 15C are explanatory drawings of a core of a second exemplary embodiment and a heat distribution.
Figure 15B:
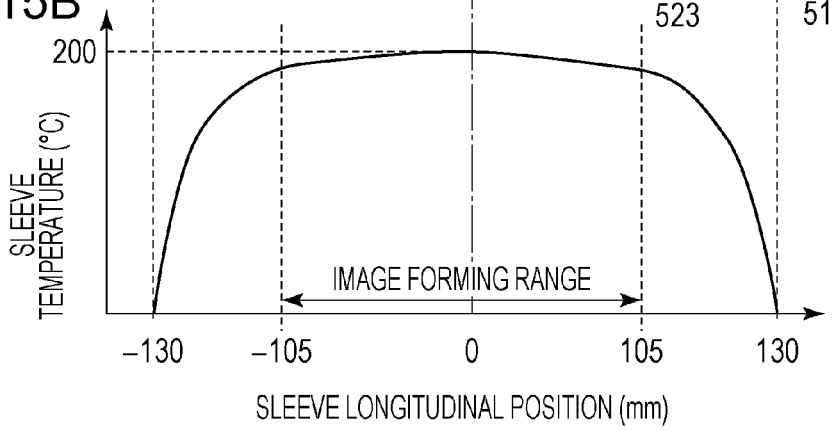
Figure 15C:
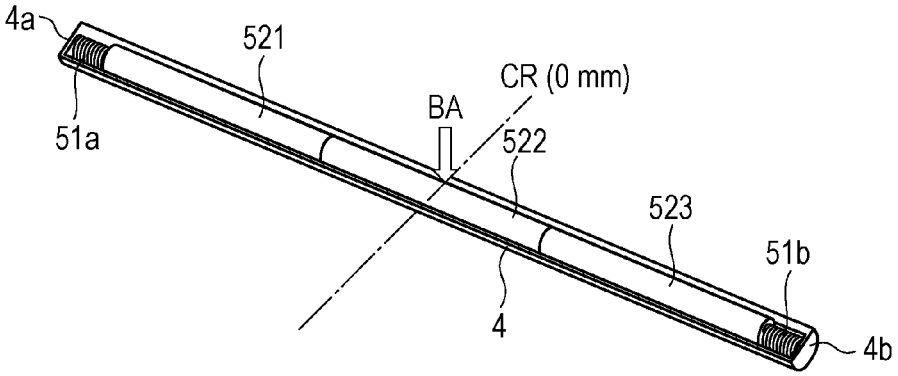

FIGS. 15A to 15C illustrate a cross-sectional view of a core of the present exemplary embodiment, a heat distribution of a fixing sleeve, and a perspective view. The divided areas of the core are indicated by C1 and C2. In the present exemplary embodiment, the magnetic flux is guided by combining three cores, namely, a core (a first magnetic member) 521, a core (a second magnetic member) 522, and a core (a third magnetic member) 523. In the present exemplary embodiment, the three cores are made to come in contact with each other by being biased by springs (biasing members) 51*a* and 51*b*. A biasing direction of the biasing members is a direction that is parallel to the helical axis of the coil. The shapes of the portions of the divided areas of the cores are each a flat surface and, accordingly, the cores each have a substantially columnar shape. Note that in FIG. 15C, the coil 3 is omitted. As illustrated in FIGS. 15A to 15C, the cores 521 to 523 on which the coil 3 has been wound are inserted into the core holder 4. The springs 51*a* and 51*b* are provided between two ends 4*a* and 4*b* of the coil holder 4, and the cores 521 to 523, and the cores are biased from both ends by forces F1 and F2 of the springs 51*a* and 51*b*. With the biasing of the springs 51*a* and 51*b*, the cores 521 to 523 are in contact with each other at the divided areas C1 and C2. Note that in the present exemplary embodiment, F1 and F2 are each set to 2 to 5 N (about 200 to 500 gf). With the above, no gap is created in the divided areas C1 and C2, and as illustrated in FIG. 15B, it is possible to generate heat in a uniform manner in the image forming range.

When mounting the fixing apparatus of the present exemplary embodiment in a center-reference printer that conveys the recording material while the middle of the recording material in the width direction is matched with the conveyance reference CR for the recording material (the middle 0 mm position of the image forming range in the present exemplary embodiment), it is desirable that the core is biased from both ends with the springs 51*a* and 51*b*. With the above, the middle of the core in the axial direction of the core can be matched more easily with the conveyance reference CR; accordingly, the temperature difference between both ends of the image forming range can be suppressed to a small degree. Furthermore, as illustrated in FIG. 15C, if the core 522 is adhered to the core holder 4 at the position of the conveyance reference CR (adhesion position BA), the temperature difference between the two ends of the image forming range can be suppressed to a further smaller degree.

In the second exemplary embodiment, an example in which the cores are biased with the springs from both ends has been given; however, one end of the cores may be abutted against the core holder and a spring may bias the cores from the other end of the cores. Such a configuration in which biasing is performed by a single spring is suitable for a one-side reference printer in which the recording material is conveyed while one side of the recording material that is parallel to the conveying direction of the recording material is matched to a conveyance reference.

Note that the cores illustrated in the first exemplary embodiment can be biased by the biasing members illustrated in the second exemplary embodiment. In such a case, the cores not only overlap each other in the helical axis direction, the cores reliably come in contact with each other; accordingly, the leaking of the magnetic flux in the divided areas can be suppressed further. Furthermore, the divided number of the core is not limited to three and can be two or any number above two.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2014-201850, filed Sep. 30, 2014, which is hereby incorporated by reference herein in its entirety.

What is claimed is:

1. A fixing apparatus for fixing a toner image on a recording material, the apparatus comprising:

a rotating member including a conductive layer;

a helical coil arranged inside the rotating member, a helical axis of the coil extending in a generatrix direction of the rotating member; and a magnetic member provided inside the coil, the magnetic member including a first magnetic member and a second magnetic member that are aligned in a line in a direction along the generatrix direction, wherein a magnetic field is formed by a current flowing in the coil wherein the toner image is fixed on the recording material by heat which the conductive layer generates by electromagnetic induction in the magnetic field, wherein a protruded portion is provided on an end surface of the first magnetic member in the generatrix direction, and a recessed portion is provided in an end surface of the second magnetic member in the generatrix direction, and wherein the protruded portion and the recessed portion are disposed so as to oppose each other and overlap each other in the generatrix direction.

2. The fixing apparatus according to claim 1, wherein a height of the protruded portion is greater than a depth of the recessed portion.

3. The fixing apparatus according to claim 1, wherein the protruded portion has a shape that becomes narrower as the protruded portion extends towards a tip thereof, and the recessed portion has a shape in which a width thereof becomes narrower as the recessed portion extends towards a bottom thereof.

4. The fixing apparatus according to claim 1, wherein a width of a base of the protruded portion is narrower than a width of a leading edge of the recessed portion.

5. The fixing apparatus according to claim 1, wherein a width of a tip of the protruded portion is narrower than a width of a bottom of the recessed portion.

6. The fixing apparatus according to claim 1, wherein an angle of an inclined surface of the protruded portion is larger than an angle of an inclined surface of the recessed portion.

7. The fixing apparatus according to claim 1, wherein the magnetic member further includes a third magnetic member, the third magnetic member being aligned in a line together with the first magnetic member and the second magnetic member in the direction extending in the generatrix direction and being provided on a side opposite the first magnetic member with the second magnetic member in between, and wherein among end surfaces of the second magnetic member in the generatrix direction, a protruded portion is provided on an end surface on a side opposite the end surface provided with the recessed portion, and among end surfaces of the third magnetic member in the generatrix direction, a recessed portion is provided in an end surface on a side opposing the second magnetic member.

8. The fixing apparatus according to claim 7, wherein the first magnetic member and the second magnetic member each have a columnar shape, and wherein, in a circumferential direction of the second magnetic member, a phase of the protruded portion of the first magnetic member and a phase of the protruded portion of the second magnetic member are substantially the same.

9. The fixing apparatus according to claim 7, wherein the first magnetic member and the second magnetic member each have a columnar shape, and wherein, in a circumferential direction of the second magnetic member, a phase of the protruded portion of the first magnetic member and a phase of the protruded portion of the second magnetic member are different.

10. The fixing apparatus according to claim 7, further comprising a biasing member that performs biasing such that the protruded portions and the recessed portions come in contact with each other.

11. The fixing apparatus according to claim 10, wherein a biasing direction of the biasing member is the generatrix direction.

12. The fixing apparatus according to claim 10, wherein the rotating member is flexible.

13. A fixing apparatus for fixing a toner image on a recording material, the apparatus comprising:

a rotating member including a conductive layer;

a helical coil arranged inside the rotating member, a direction of a helical axis of the coil extending in a generatrix direction of the rotating member; and a magnetic member provided inside the coil, the magnetic member including a first magnetic member and a second magnetic member that are arranged in a line extending in the generatrix direction, wherein the toner image is fixed on the recording material by heat generated by the conductive layer caused by electromagnetic induction, and wherein a biasing member that performs biasing such that the first magnetic member and the second magnetic member come in contact with each other is provided.

14. The fixing apparatus according to claim 13, wherein a biasing direction of the biasing member is the generatrix direction.

* * * * *